US008668198B2

(12) United States Patent
Tsuji et al.

(10) Patent No.: US 8,668,198 B2
(45) Date of Patent: Mar. 11, 2014

(54) SHEET PROCESSING APPARATUS AND IMAGE FORMING APPARATUS

(75) Inventors: Hiroharu Tsuji, Numazu (JP); Masatoshi Yoshida, Susono (JP); Tomooku Koyama, Suntou-gun (JP); Junichi Sekiyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/570,695

(22) Filed: Aug. 9, 2012

(65) Prior Publication Data

US 2013/0049283 A1 Feb. 28, 2013

(30) Foreign Application Priority Data

Aug. 23, 2011 (JP) ..... 2011-181640

(51) Int. Cl.
*B65H 31/36* (2006.01)

(52) U.S. Cl.
USPC ..... 271/221; 271/220; 270/58.08; 270/58.12

(58) Field of Classification Search
USPC ..... 271/3.01, 3.02, 3.03, 245, 246, 241, 271/220, 221; 270/58.08, 58.27, 52.16, 270/52.18, 58.01
See application file for complete search history.

(56) References Cited

U.S. PATENT DOCUMENTS

| | | | | |
|---|---|---|---|---|
| 5,857,137 | A * | 1/1999 | Sakata et al. | 399/402 |
| 6,030,165 | A | 2/2000 | Ishida | |
| 6,733,007 | B2 | 5/2004 | Sekiyama et al. | |
| 6,912,044 | B2 | 6/2005 | Sekiyama et al. | |
| 6,988,730 | B2 | 1/2006 | Fukatsu et al. | |
| 7,264,237 | B2 * | 9/2007 | Kato et al. | 270/58.12 |
| 7,472,901 | B2 * | 1/2009 | Nishimura et al. | 270/58.12 |
| 7,530,566 | B2 * | 5/2009 | Terao et al. | 271/207 |
| 7,753,368 | B2 | 7/2010 | Sekiyama et al. | |
| 7,874,558 | B2 | 1/2011 | Ogata et al. | |
| 8,038,147 | B2 | 10/2011 | Ogata et al. | |
| 8,061,712 | B2 | 11/2011 | Tsuji et al. | |
| 8,123,209 | B2 * | 2/2012 | Kubota et al. | 270/58.07 |
| 8,251,361 | B2 * | 8/2012 | Taki et al. | 270/58.12 |
| 8,267,399 | B2 * | 9/2012 | Kushida et al. | 271/233 |
| 2004/0070141 | A1 * | 4/2004 | Michels et al. | 271/220 |
| 2010/0264581 | A1 | 10/2010 | Sekiyama et al. | |
| 2012/0025455 | A1 | 2/2012 | Tsuji et al. | |

FOREIGN PATENT DOCUMENTS

| | | | |
|---|---|---|---|
| EP | 855287 | A2 | 7/1998 |
| EP | 855287 | A3 | 9/1998 |
| EP | 855287 | B1 | 4/2001 |
| JP | 2001-348153 | A | 12/2001 |
| JP | 3868719 | B2 | 1/2007 |

* cited by examiner

*Primary Examiner* — Kaitlin Joerger
(74) *Attorney, Agent, or Firm* — Fitzpatrick, Cella, Harper & Scinto

(57) ABSTRACT

A controller controls operations of a sheet conveying portion and a sheet feeding portion in such a manner that an operation for feeding a preceding sheet by the sheet feeding portion is started after a downstream portion of a subsequent sheet conveyed by the sheet conveying portion is overlapped an upstream portion of the preceding sheet stacked on the stacking portion, and the downstream edge of the preceding sheet is caused to abut against the reference member by the sheet feeding portion in a state where the upstream portion of the preceding sheet and the downstream portion of the subsequent sheet are maintained in an overlapped state.

24 Claims, 8 Drawing Sheets

SHEET PROCESSING APPARATUS AND IMAGE FORMING APPARATUS

BACKGROUND OF THE INVENTION

1. Field of the Invention

The present invention relates to a sheet processing apparatus which performs a process such as an alignment process for aligning edges of sheets, and an image forming apparatus including the sheet processing apparatus.

2. Description of the Related Art

There is known a system in which sheets are aligned using a conveying direction downstream edge (leading edge) of each sheet as an alignment reference in a sheet processing apparatus which performs a process, such as a binding process, after aligning the sheets. To handle various sheet sizes in this sheet processing apparatus, the position of a conveying direction upstream edge (trailing edge) of each of the aligned sheets varies depending on the sheet size. For this reason, it is necessary to take some measures to prevent a subsequent sheet from abutting against the trailing edge of the preceding aligned sheet and from slipping under the preceding sheet, for example.

As a solution to such a problem, a structure is disclosed in which a sufficient difference in height between a sheet aligning portion and a conveying portion which conveys sheets to the sheet aligning portion is ensured in a height direction. As another solution to the problem, there is disclosed a structure in which the sheet conveying portion is moved to the sheet aligning portion along a conveying direction according to the sheet size (U.S. Pat. No. 6,030,165), or a structure in which a reference member or a sheet processing portion is moved according to the sheet size. As still another solution to the problem, there is disclosed a structure in which large-size sheets are aligned using the leading edge thereof as a reference and small-size sheets are aligned using the trailing edge thereof as a reference, and a sheet bundle is then moved toward the leading edge reference (Japanese Patent Laid-Open No. 2001-348153).

However, the structure in which a sufficient difference in height between the sheet aligning portion and the conveying portion which conveys sheets to the sheet aligning portion is ensured in the height direction has a problem in that the size of the apparatus is increased in the height direction.

The structure for moving the conveying portion as disclosed in U.S. Pat. No. 6,030,165 and the structure for moving the alignment reference or the sheet processing portion require an actuator for moving such portions, leading to complication of the structure and an increase in cost. Furthermore, these structures require a space for moving such portions, leading to an increase in the size of the apparatus.

Also the structure disclosed in Japanese Patent Laid-Open No. 2001-348153 requires an actuator for moving such portions, leading to complication of the structure and an increase in cost. Additionally, the structure requires a space for moving such portions, leading to an increase in the size of the apparatus.

SUMMARY OF THE INVENTION

Therefore, it is an object of the present invention to prevent a subsequent sheet from colliding with or slipping under a preceding sheet with a simple structure, without causing an increase in apparatus size and an increase in cost.

According to the present invention, there is provided a sheet processing apparatus including: a stacking portion which stacks a sheet; a sheet conveying portion which conveys the sheet to the stacking portion; a reference member against which a downstream edge of the sheet in a conveying direction abut for aligning the downstream edge of the sheet; a sheet feeding portion which feeds the sheet in the conveying direction to cause the sheet to abut against the reference member; and a controller which controls operations of the sheet conveying portion and the sheet feeding portion, wherein the controller controls the sheet conveying portion and the sheet feeding portion in such a manner that an operation for feeding a preceding sheet by the sheet feeding portion is started after a downstream portion of a subsequent sheet conveyed by the sheet conveying portion in the conveying direction is overlapped an upstream portion of the preceding sheet in the conveying direction, and downstream edge of the preceding sheet is caused to abut against the reference member by the sheet feeding portion in a state where the upstream portion of the preceding sheet and the downstream portion of the subsequent sheet are maintained in an overlapped state.

According to the present invention, the downstream edge of the preceding sheet is aligned by the sheet feeding portion in a conveying direction after a downstream portion of a subsequent sheet conveyed by the sheet conveying portion is overlapped an upstream portion of a preceding sheet stacked on the stacking portion. This structure prevents the subsequent sheet from colliding with or sliding under the preceding sheet with a simple structure.

Further features of the present invention will become apparent from the following description of exemplary embodiments with reference to the attached drawings.

DESCRIPTION OF THE EMBODIMENTS

Exemplary embodiments of the present invention will be described in detail below by way of example with reference to the drawings. Note that the dimensions, material, shape, and relative layout, and the like of components described in the embodiments described below can be appropriately changed depending on the structure of an apparatus to which the present invention is applied and various conditions. Accordingly, unless otherwise specified, the scope of the present invention is not limited to the embodiments.

First Embodiment

Figure 1:
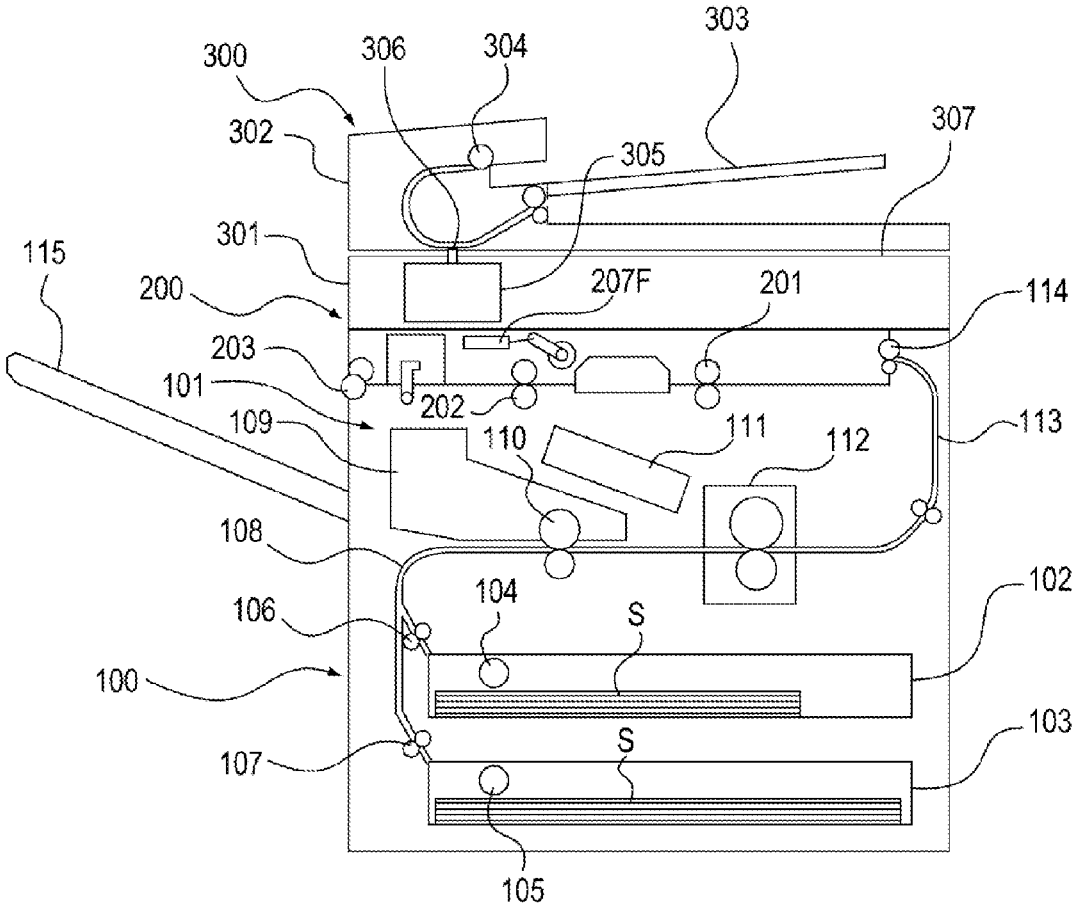
FIG. 1 is a schematic sectional view of an image forming apparatus including a sheet processing apparatus.

Referring to FIG. 1, a sheet processing apparatus and an image forming apparatus according to a first embodiment of the present invention will be described. FIG. 1 is a schematic diagram illustrating the image forming apparatus including the sheet processing apparatus according to the first embodiment.

As illustrated in FIG. 1, a sheet processing apparatus 200 according to the first embodiment is connected between an image forming apparatus body 100 and an image reading portion 300, and receives sheets from the image forming apparatus body 100. In a case of performing a process on the sheets, the edges of the sheets are aligned to perform a predetermined process, such as stapling, on the sheets.

The image forming apparatus body 100 includes a printer portion 101 which forms an image on each sheet. The printer portion 101 includes an image forming portion including a photosensitive drum and the like which will be described later.

The image forming apparatus body 100 causes a plurality of sheets S stacked on a sheet cassette 102 (or 103) to be separated one by one and fed by a feeding roller 104 (105) and a separation conveying roller 106 (107), thereby conveying the sheets to an image forming process unit 109 along a conveying guide 108.

The image forming process unit 109 is an image forming portion which forms an image (toner image) by an electrophotographic system. Specifically, the image forming process unit 109 forms an electrostatic latent image such that a laser scanner 111 irradiates a photosensitive drum 110 serving as a charged image bearing member with light. Further, the image forming process unit 109 develops the electrostatic latent image into a toner image by using toner, and transfers the toner image onto each sheet S.

Each sheet S having the toner image transferred thereon from the photosensitive drum 110 is conveyed to a fixing device 112 where heat and pressure is applied to the sheet S to fix the image thereon. The sheet S having the image fixed thereon is conveyed to a pair of conveying rollers 114 along a conveying guide 113.

When no process is performed on the sheet S, the sheet S is transported to a tray 115 by pairs of conveying rollers 201 and 202 and a pair of discharge rollers 203 and is stacked on the tray 115.

The operation for performing a process on the sheet S will be described in detail later.

The image reading portion 300 includes a scanner portion 301 and an automatic original document feeding portion (hereinafter referred to as "ADF") 302. The ADF 302 causes a plurality of originals stacked on an original stack tray 303 to be separated one by one and fed by a feeding roller 304, and causes the originals to pass through an original reading position 306 where an optical carriage 305 of the scanner portion 301 stops. The ADF 302 is enabled with a hinge (not illustrated) provided on the back side of the apparatus to be opened and closed, and opens/closes the hinge when the originals are stacked on an original base plate glass.

In the scanner portion 301, the optical carriage 305 scans each original stacked on the original base plate glass 307 in the horizontal direction to thereby read information written on each original, and a CCD performs photoelectric conversion. In the case of reading each original by the ADF 302, the optical carriage 305 stops at the original reading position 306 to read the information written on the original being conveyed.

Figure 2A:
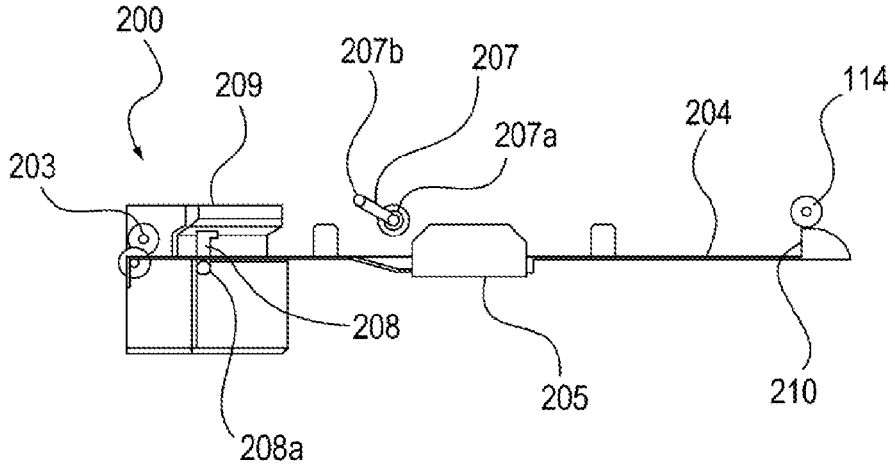
FIG. 2A is a configuration diagram illustrating a sheet processing apparatus according to a first embodiment of the present invention.
Figure 2B:
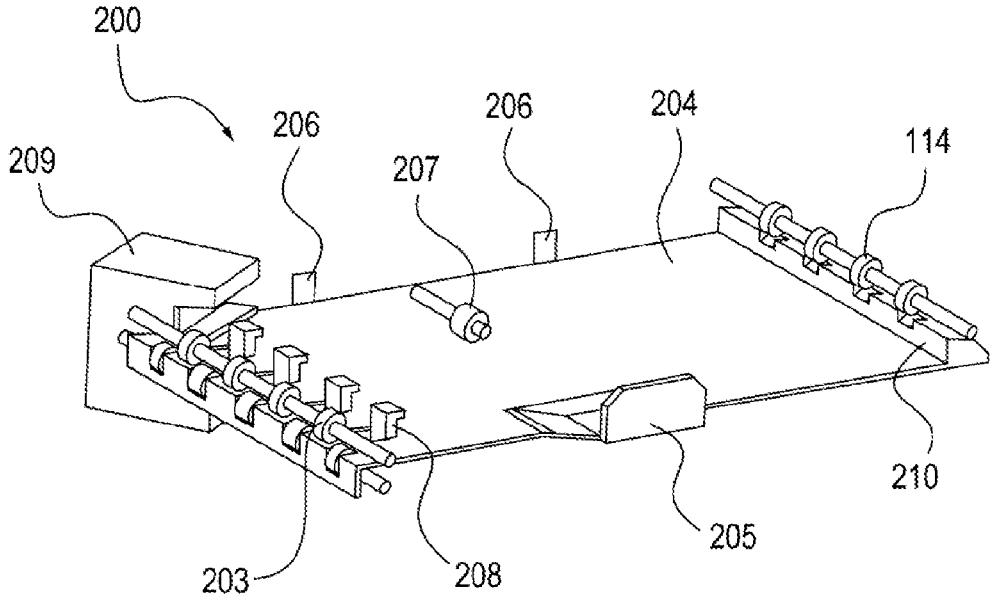
FIG. 2B is a perspective view of the sheet processing apparatus according to the first embodiment.

Next, the sheet processing apparatus 200 will be described. FIG. 2A is a configuration diagram of the sheet processing apparatus 200. FIG. 2B is a perspective view of the sheet processing apparatus 200. In FIGS. 2A and 2B, the pair of conveying rollers 201 and 202 is not illustrated. The pair of conveying rollers 201 and 202 releases the nipping thereof so as not to interfere with the alignment of the sheets when a process is performed on each sheet, and the conveying rollers 201 and 202 retract to positions separated from each other.

The sheet processing apparatus 200 includes a processing tray 204 having an upper surface which is a substantially horizontal stacking surface, an aligning portion 205, a reference member 206, a sheet feeding roller 207, a reference member 208, and a binding processing portion 209. The processing tray 204 is a stacking portion which temporarily stacks sheets when a process is performed on each sheet. The aligning portion 205 moves in a direction (hereinafter referred to as "width direction") perpendicular to a sheet conveying direction, and presses side edges of the sheets stacked on the processing tray 204 to thereby align the sheets. The reference member 206 aligns the edges in the width direction of the sheets by allowing the side edges of the sheets moved in the width direction by the aligning portion 205 to abut against the reference member 206. The sheet feeding roller 207 serving as a sheet feeding portion is provided above a sheet stacking surface of the processing tray 204. The sheet feeding roller 207 is provided to be able to abut against or be separated from the sheets stacked on the sheet stacking surface of the processing tray 204. The reference member 208 projects from the sheet stacking surface of the processing tray 204, and aligns the edges in the sheet conveying direction by allowing conveying direction downstream edges (leading edges) of the sheets fed in the conveying direction by the sheet feeding roller 207 to abut against the reference member 208. The reference member 208 is provided to be movable to a position projecting from the sheet stacking surface of the processing tray 204 serving as an alignment reference, and to a position which does not interfere with the discharging of the sheets from the processing tray 204. The binding processing portion 209 performs a binding process on a sheet bundle including a plurality of aligned sheets.

The sheet feeding roller 207 includes a roller portion 207*a* serving as a sheet feeding portion which abuts against the sheets to feed the sheets. The sheet feeding roller 207 causes the roller portion 207*a* to abut against the sheets to be rotated by an actuator (not illustrated), thereby enabling conveyance of the sheets to a conveying direction downstream side. In the first embodiment, the conveyance speed of the sheet feeding roller 207 is set to be equal to the conveyance speed of the pair of conveying rollers 114. The sheet feeding roller 207 is structured to swing by the actuator 207F with a fulcrum 207*b* as a rotation center, and to allow the roller portion 207*a* to abut against or be separated from the sheet upper surface. Further, a friction coefficient of the roller portion 207*a* is set to a friction coefficient that allows the roller portion 207*a* to slip on each sheet S when the leading edge (conveying direction downstream edge) of the sheet S abuts against the reference member 208. Alternatively, the roller portion 207*a* may be structured to allow the roller portion 207*a* to slip on each sheet when the leading edge of the sheet S abuts against the reference member 208 by using a torque limiter.

The reference member 208 is structured to rotate counterclockwise in FIG. 2A with a fulcrum 208*a* as a center when a sheet bundle is discharged after completion of the binding process for the sheet bundle or when the sheet bundle is discharged without performing the binding process, and to be movable to a position retracted from the sheet stacking surface. The position retracted from the sheet stacking surface is a position which does not interfere with the discharging of the sheet bundle from the processing tray 204. Note that if the sheet bundle is switched back and discharged in the direction opposite to the conveying direction of the sheet feeding roller 207, there is no need to retract the reference member 208.

To sequentially stack the conveyed sheets in an overlapped manner, the sheet stacking surface of the processing tray 204 is provided at a position lower by one stage than a nip line of the pair of conveying rollers 114. Further, assuming that a wall surface at a position lower by one stage is defined as a wall surface 210, the distance between an abutting surface of the reference member 208 and the wall surface 210 is set to be slightly longer than the length in the conveying direction of a longest sheet that can be subjected to a sheet process.

Next, FIGS. 3A to 3G illustrate process operations when a process is performed on a sheet in the sheet processing apparatus 200. FIGS. 3A to 3G illustrate an operation for processing a sheet having a size (for example, letter size) shorter than a longest sheet size (for example, legal size) that can be subjected to a sheet process.

Figure 3A:
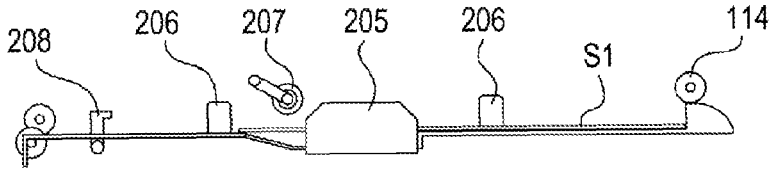
FIGS. 3A to 3G are explanatory diagrams each illustrating operation of the sheet processing apparatus according to the first embodiment.

FIG. 3A illustrates a state where a first sheet S1 of a job subjected to performing a binding process is conveyed from the image forming apparatus by the pair of conveying rollers 114, and the trailing edge of the sheet S1 passes through the pair of conveying rollers 114 and is discharged to the processing tray 204. At this time, the sheet feeding roller 207 is disposed at a position where the sheet feeding roller 207 can abut against the sheet S1. At this point, the sheet feeding roller 207 is disposed at a position separated from the processing tray 204. As described above, though not illustrated in FIG. 3, the nipping of the pair of conveying rollers 201 and 202 is released, thereby allowing the conveying rollers 201 and 202 to be separated from each other.

Figure 3B:
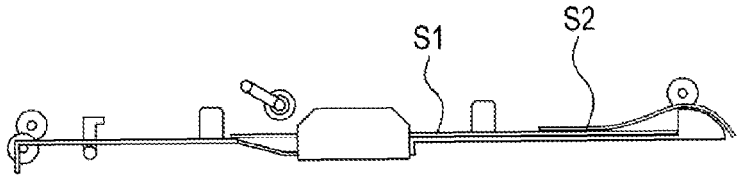

FIG. 3B illustrates a state where a second sheet S2 of the job is conveyed to the processing tray 204. At this time, the edge of the sheet S1 is pressed by the aligning portion 205 to abut against the reference member 206 and is subjected to an alignment process before the leading edge of the sheet S2 reaches an operation area of the aligning portion 205. In addition, the aligning portion 205 retracts to an outside of a sheet conveying area again to be ready for the subsequent sheet. At this time, the alignment process in the conveying direction is not performed on the sheet S1, and the trailing edge of the sheet S1 is positioned below the pair of conveying rollers 114. Accordingly, the leading edge of the sheet S2 is landed on the surface of the sheet S1 without contacting the trailing edge of the sheet S1. That is, a state (overlapped state) is obtained in which a portion at the trailing edge side of the preceding sheet S1 (conveying direction upstream portion) and a portion at the leading edge side of the subsequent sheet S2 (conveying direction downstream portion) overlap each other in the conveying direction.

After that, the sheet feeding roller 207 swings and abuts on the surface of the sheet S1, thereby starting a feeding operation to move the sheet S1 to the reference member 208. Meanwhile, the sheet S2 is continuously conveyed by the pair of conveying rollers 114. At this time, the sheet S1 and the sheet S2 are conveyed in the same direction while the trailing edge of the preceding sheet S1 and the leading edge of the subsequent sheet S2 are maintained in the overlapped state in the conveying direction. Then, the leading edge of the sheet S1 abuts against the reference member 208.

Figure 3C:
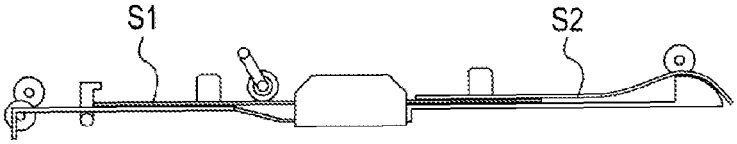

FIG. 3C illustrates a state at where the leading edge of the sheet S1 reaches the reference member 208. It should be noted here that the leading edge of the sheet S2 overlapping the trailing edge of the sheet S1 has not reached the sheet feeding roller 207 yet. This is because if the leading edge of the sheet S2 reaches the sheet feeding roller 207 before the leading edge of the sheet S1 reaches the reference member 208, the sheet feeding roller 207 cannot contact the sheet S1, which results in that the alignment process for the sheet S1 is not performed.

Figure 3D:
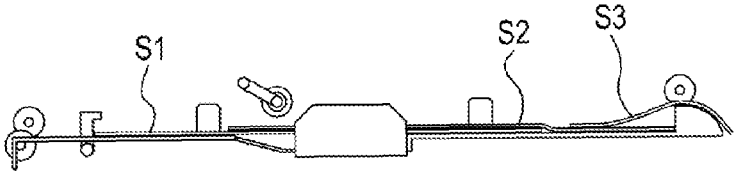

Next, the sheet feeding roller 207 is separated from the sheet S1 before the trailing edge of the sheet S2 reaches the pair of conveying rollers 114. As illustrated in FIG. 3D, the sheet S2 is stacked on the processing tray 204 after the trailing end of the sheet S2 passing through the pair of conveying rollers 114, and the alignment process in the sheet conveying direction is not performed until the leading edge of a third sheet S3 overlaps the trailing edge of the sheet S2. In other words, the sheet feeding roller 207 does not start the conveyance in the sheet conveying direction of the sheet S2 until the leading edge of the third sheet S3 overlaps the trailing edge of the sheet S2. This is similar to the alignment operation between the sheet S1 and the sheet S2 described above. Note that timings for causing the sheet feeding roller 207 to abut against or be separated from each sheet, and the sheet convey distance (amount of rotation of rollers) are controlled by a controller, which will be described later, based on sheet size information and time information between sheets which are sent from the image forming apparatus body.

The operations illustrated in FIGS. 3B to 3D described above are repeated by a predetermined number of sheets for a job.

Figure 3E:
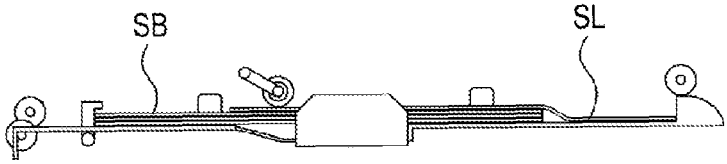
Figure 3F:
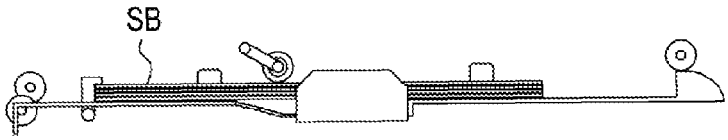

FIG. 3E illustrates a state where the trailing edge of a last sheet SL of the job passes through the pair of conveying rollers 114. FIG. 3F illustrates a state where the alignment process in the conveying direction for the last sheet SL of the job is finished. Since there is no sheet subsequent to the last sheet SL, the alignment process in the conveying direction may be started immediately after the trailing edge of the sheet passes through the pair of conveying rollers 114. The sheet feeding roller 207 feeds the last sheet SL to continue the conveyance of the sheet by the pair of conveying rollers 114.

Figure 3G:
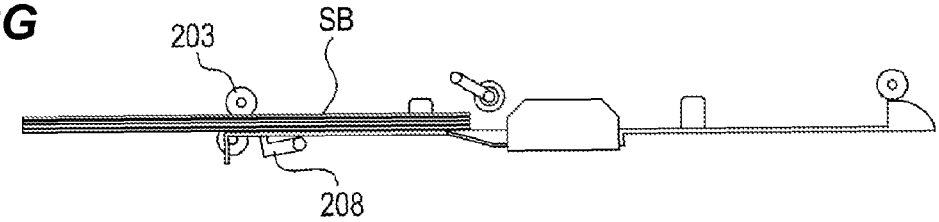

After completion of the alignment process for all sheets for one job, the binding processing portion 209 performs a process on a sheet bundle SB. After that, the reference member 208 retracts from the sheet stacking surface, and the pair of conveying rollers 201 and 202 separated from each other nips the sheet bundle SB. The sheet bundle SB is discharged to the tray 115 by the pair of conveying rollers 201 and 202 and the pair of discharge rollers 203 serving as a bundle discharge portion (FIG. 3G).

Figure 4:
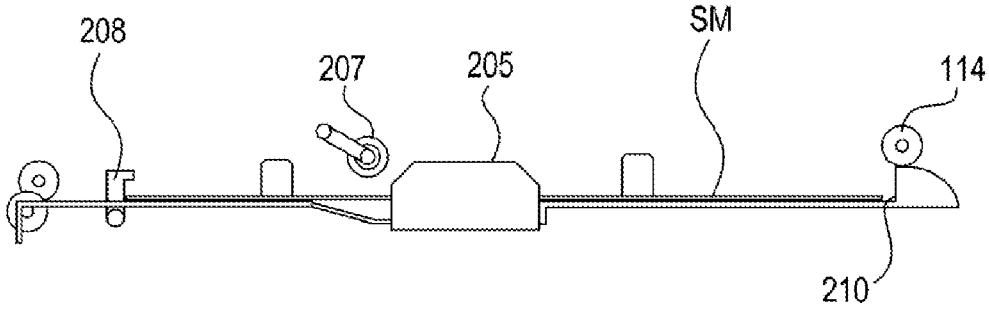
FIG. 4 is an explanatory diagram illustrating the sheet processing apparatus according to the first embodiment.

On the other hand, FIG. 4 illustrates a state diagram in which a longest sheet SM, which is longest in length in the conveying direction, is stacked on the processing tray 204 and the alignment process in the conveying direction is finished. As described above, the distance between the abutting surface of the reference member 208 and the wall surface 210 is set to be slightly longer than the length in the conveying direction of the longest sheet SM. Accordingly, in the longest sheet SM, the leading edge of the subsequent sheet can be prevented from colliding with or slipping under the trailing edge of the preceding sheet. Therefore, there is no need to wait for the alignment process in the conveying direction of the preceding sheet until the subsequent sheet is conveyed.

The operations of the sheet processing apparatus 200 upon execution of the alignment process and the binding process on the sheet have been described above. Note that the operation timing for each conveying portion or each alignment portion, for example, is controlled by the controller illustrated in FIG. 7 based on the sheet size information and sheet position information which are sent from the image forming apparatus body.

Figure 7:
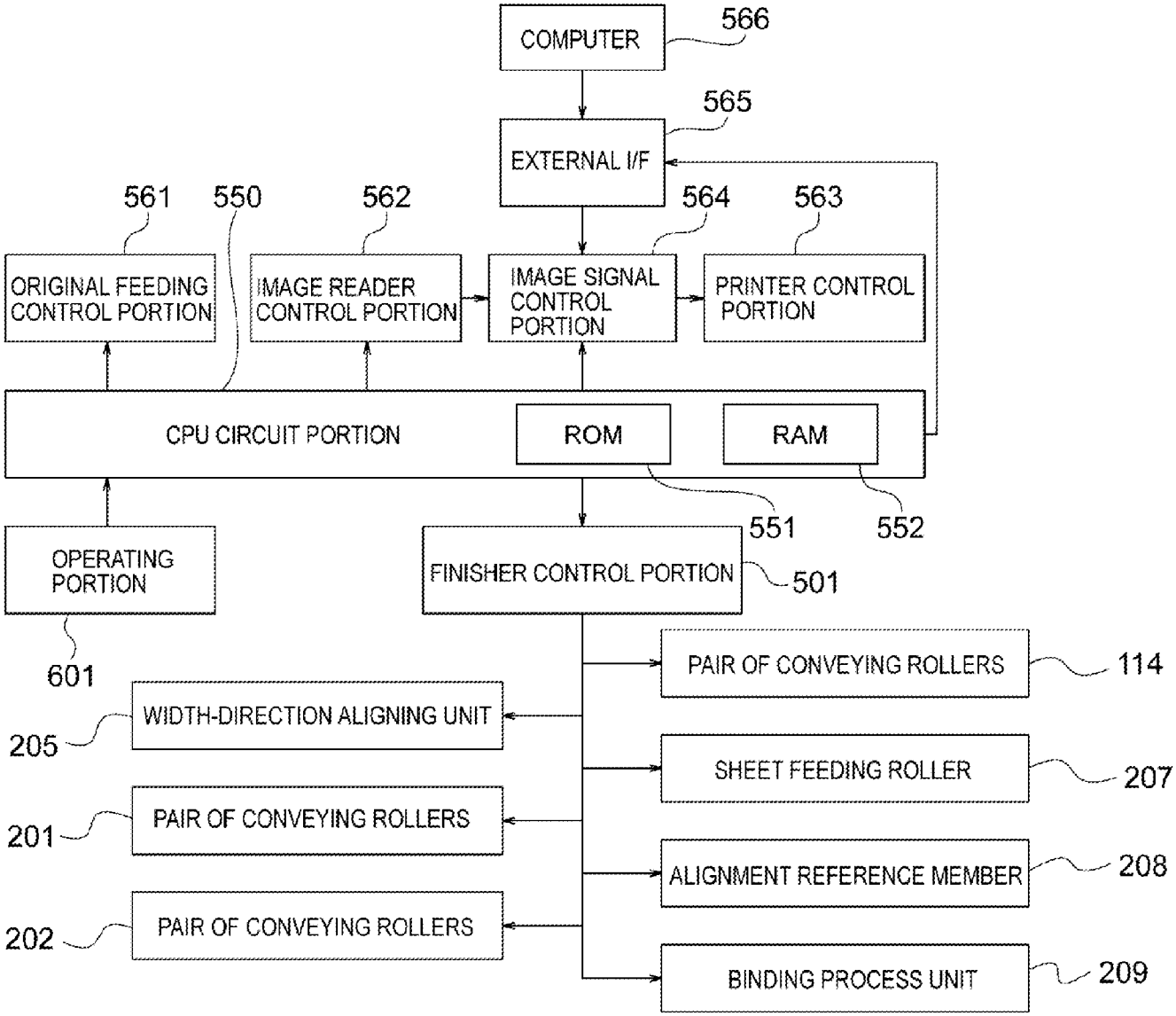
FIG. 7 is a block diagram illustrating a control system of the image forming apparatus.

Referring now to FIG. 7, a control system of the image forming apparatus will be described. FIG. 7 is a block diagram illustrating the structure of the control system of the image forming apparatus. A CPU circuit portion 550 is provided in the image forming apparatus body 100 and includes a CPU (not illustrated), a ROM 551, and a RAM 552. The CPU circuit portion 550 controls portions described below according to a control program stored in the ROM 551 and the settings of the operation portion 601. Specifically, the CPU circuit portion 550 controls an original feeding control portion 561, an image reader control portion 562, an image signal control portion 564, a printer control portion 563, a finisher control portion (controller) 501, and an external I/F (external interface) 565.

The original feeding control portion 561 controls the automatic original document feeding portion (ADF) 302 of the image reading portion 300. The image reader control portion 562 controls the scanner portion 301 of the image reading portion 300. The printer control portion 563 controls the printer portion 101. Further, the finisher control portion 501 is mounted on the sheet processing apparatus 200 and controls the sheet processing apparatus 200. Specifically, the operations of the portions 114, 201, 202, 205, 207, 208, and 209 of the sheet processing apparatus 200 described above are controlled by the finisher control portion 501.

The operation portion 601 includes a plurality of keys for setting various functions related to the formation of images, and a display portion for displaying setting states. The operation portion 601 outputs a key signal corresponding to each key operation by a user to the CPU circuit portion 550, and displays corresponding information on the display portion based on a signal from the CPU circuit portion 550.

The RAM 552 is used as an area for temporarily holding control data, or a work area for operations associated with the control. The external I/F 565 is an interface between the image forming apparatus and an external computer 566. The external I/F 565 develops print data supplied from the computer 566 into a bitmapped image, and outputs the bitmapped image as image data to the image signal control portion 564. An image of an original read by an image sensor included in the optical carriage 305 is output from the image reader control portion 562 to the image signal control portion 564. The printer control portion 563 outputs the image data supplied from the image signal control portion 564 to the laser scanner 111.

The first embodiment illustrates the structure in which the finisher control portion 501 serving as a controller which controls the operations of each portion of the sheet processing apparatus 200 described above is mounted on the sheet processing apparatus 200, but the present invention is not limited to this. For example, this controller may be provided in the printer portion 101 integrally with the CPU circuit portion 550 to control the sheet process apparatus 200 from the printer portion 101 side.

As described above, according to the first embodiment, the trailing edge of the preceding sheet stacked on the processing tray is allowed to overlap the leading edge of the subsequent sheet, and the alignment process in the conveying direction of the preceding sheet is then performed in the state where the both sheets overlap each other. This structure prevents the subsequent sheet from colliding with or slipping under the preceding sheet with a simple structure, without causing an increase in apparatus size and an increase in cost.

Also by reducing the difference in the height direction between the processing tray 204 and the pair of conveying rollers 114, the subsequent sheet can be prevented from colliding with or slipping under the preceding sheet. This enables reduction in thickness of the apparatus.

Additionally, there is no need to move an alignment reference member or a sheet conveying portion according to the sheet size, which has been conventionally required. This enables reduction in the number of actuators and reduction in size, thereby achieving a reduction in cost and downsizing of the apparatus.

Moreover, the achievement of a reduction in thickness enables suppression of the height even when the sheet processing apparatus is disposed between the image forming apparatus body and the image reading portion as illustrated in FIG. 1. The sheet processing apparatus, which has been conventionally mounted to a side surface of an image forming apparatus, is disposed between the image forming apparatus body and the image reading portion, thereby enabling reduction in exclusive area (footprint) of the image forming apparatus.

Second Embodiment

The first embodiment illustrates the case where the conveying speed of the pair of conveying rollers 114 is set to be equal to the conveying speed of the sheet feeding roller 207, but the present invention is not limited to this. A second embodiment of the present invention illustrates the case where the conveying speed is different from the conveying speed of the sheet feeding roller 207.

If Conditions 1 and 2 described below are satisfied, there is no need to set the conveying speed of the pair of conveying rollers 114 to be equal to the conveying speed of the sheet feeding roller 207.

Condition 1 is that the overlapped state between the trailing edge of the preceding sheet and the leading edge of the subsequent sheet is maintained until the preceding sheet reaches the reference member 208. Condition 2 is that the preceding sheet reaches the reference member 208 before the subsequent sheet reaches the sheet feeding roller 207.

The Condition 1 is a condition for preventing the leading edge of the subsequent sheet from colliding with or sliding under the trailing edge of the preceding sheet. The Condition 2 is a condition for allowing the preceding sheet to be aligned by the sheet feeding roller 207 until reaching the reference member 208. Specifically, these conditions are formulated as the following conditional expressions 1 and 2.

Figure 5:
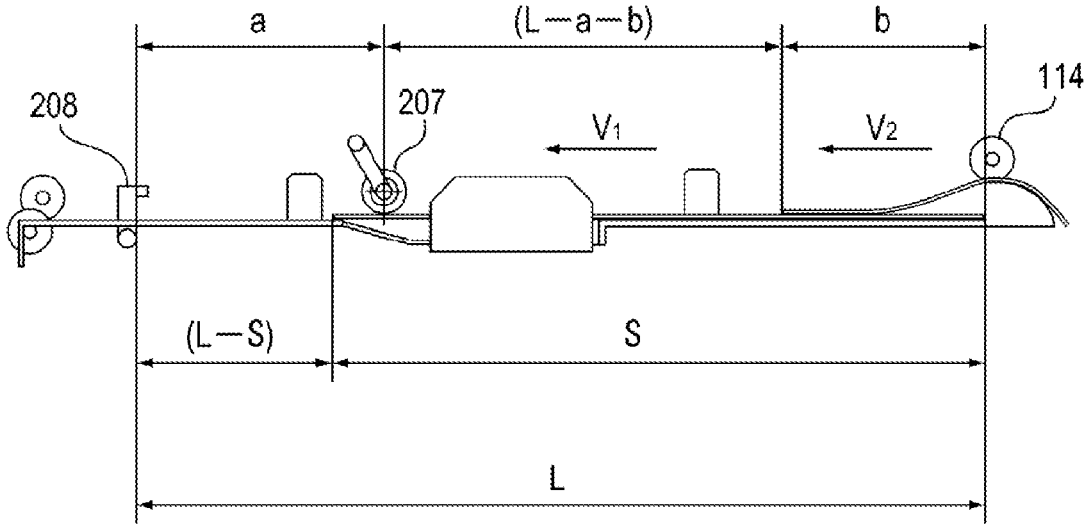
FIG. 5 is an explanatory diagram illustrating a sheet processing apparatus according to a second embodiment of the present invention.

Referring first to FIG. 5, a distance "a" is a distance from the abutting surface of the reference member 208 and the nip portion of the sheet feeding roller 207; an overlap amount "b" is an overlap amount between the preceding sheet and the subsequent sheet; a length "S" is a length in the conveying direction of a sheet; a length "L" is a length in the conveying direction of the processing tray 204; a conveying speed "V1" is a conveying speed for conveying a sheet by the sheet feeding roller 207; and a conveying speed "V2" is a conveying speed for conveying a sheet by the pair of conveying rollers 114.

Assuming herein that "t" represents a time for the preceding sheet S1 stacked on the processing tray 204 to be conveyed by the sheet feeding roller 207 and to reach the reference member 208, this time "t" is expressed as $t=(L-S)/V1$.

At this time, the conditional expression 1 is formulated as $V1 \cdot t - V2 \cdot t < b$, and the conditional expression 2 is formulated as $(L-S)/V1 < (L-a-b)/V2$.

In addition to the advantageous effect described in the first embodiment, if the above-mentioned conditions are satisfied, there is an advantageous effect that it is not necessary to set the conveying speed of the sheet feeding roller 207 to be equal to the conveying speed of the pair of conveying rollers 114, thereby widening the width of the control timing.

As long as the above conditions 1 and 2 are satisfied, it is not necessary that the conveying speeds V1 and V2 are set at a constant speed. Further, if the above conditions 1 and 2 are satisfied, the conveying speeds V1 and V2 may be accelerated or decelerated during conveyance of a sheet. When the acceleration/deceleration is included, the above conditional expressions 1 and 2 are not satisfied.

Third Embodiment

Next, a third embodiment of the present invention will be described. The third embodiment differs from the above-described first and second embodiments in that a plurality of sheet feeding portions is provided along the sheet conveying direction.

FIGS. 6A to 6E illustrate a configuration including two sheet feeding portions as an example of a configuration including a plurality of sheet feeding portions. Specifically, a feeding roller 211 serving as a sheet feeding portion is further disposed at a position closer to the reference member 208 than the sheet feeding roller 207 serving as a sheet feeding portion. The sheet feeding roller 211 is provided at the conveying direction downstream side of the sheet with respect to the sheet feeding roller 207, and has a structure similar to that of the sheet feeding roller 207.

Operations of the third embodiment illustrated in FIGS. 6A to 6E will be described in time series. In this case, however, differences from the first and second embodiments described above will be mainly described.

Figure 6A:
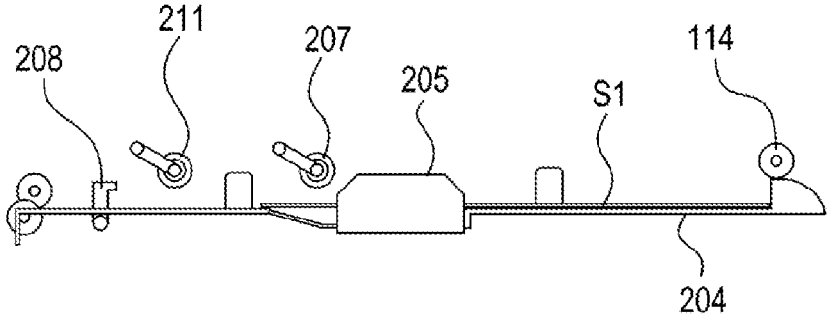
FIGS. 6A to 6E are explanatory diagrams each illustrating operation of a sheet processing apparatus according to a third embodiment of the present invention.

FIG. 6A illustrates a state where the first sheet S1 of a job for performing a binding process is conveyed from the image forming apparatus body by the pair of conveying rollers 114, and the trailing edge of the sheet S1 passes through the pair of conveying rollers 114 and is discharged onto the processing tray 204. At this time, the sheet feeding roller 207 retracts to a position separated from the processing tray 204. Though not illustrated in FIGS. 6A to 6E, the nipping of the pair of conveying rollers 201 and 202 is released, thereby allowing the conveying rollers 201 and 202 to be separated from each other.

Figure 6B:
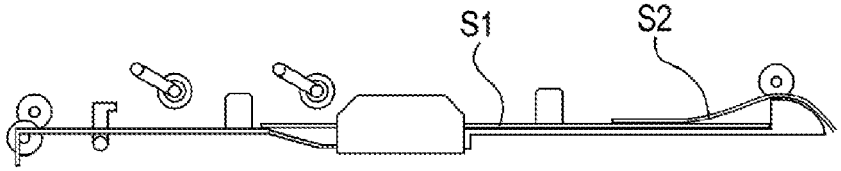

FIG. 6B illustrates a state where the second sheet S2 used in the job is conveyed to the processing tray 204 by the pair of conveying rollers 114. That is, a state (overlapped state) is obtained in which the trailing edge of the preceding sheet S1 and the leading edge of the subsequent sheet S2 overlap each other in the conveying direction on the processing tray 204.

After that, the sheet feeding roller 207 swings and abuts on the surface of the sheet S1, thereby starting the feeding operation to move the sheet S1 to the reference member 208. Meanwhile, the subsequent sheet S2 is continuously conveyed by the pair of conveying rollers 114. At this time, the sheet S1 and the sheet S2 are conveyed in the same direction while the trailing edge of the preceding sheet S1 and the leading edge of the subsequent sheet S2 are maintained in the overlapped state in the conveying direction.

Figure 6C:
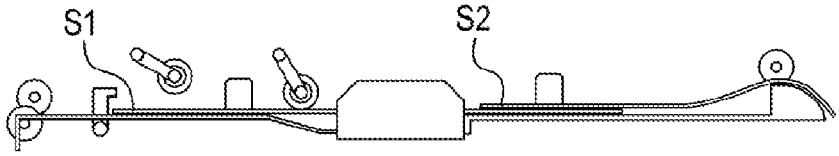

FIG. 6C illustrates a state where the preceding sheet S1 is conveyed in the conveying direction by the sheet feeding roller 207 and the subsequent sheet S2 is conveyed by the pair of conveying rollers 114. The preceding sheet S1 is conveyed by the sheet feeding roller 207 in this manner until just immediately before the leading edge (conveying direction downstream edge) of the preceding sheet S1 reaches the abutting surface of the reference member 208.

After that, when the leading edge of the preceding sheet S1 reaches the sheet feeding roller 211 in the vicinity of the reference member 208, the sheet feeding roller 207 is separated from the preceding sheet S1 and the sheet feeding roller 211 abuts against the preceding sheet S1 to start the feeding operation.

Figure 6D:
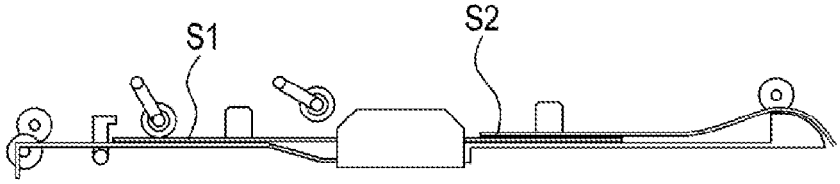

FIG. 6D illustrates a state where the sheet feeding roller 207 having abutted on the surface of the preceding sheet S1 is separated from the preceding sheet S1 and the sheet feeding roller 211 abuts on the surface of the preceding sheet S1 instead. At this time, the subsequent sheet S2 is continuously conveyed by the pair of conveying rollers 114, and the preceding sheet S1 and the subsequent sheet S2 are conveyed in the same direction while maintaining the state where the trailing edge of the preceding sheet S1 and the leading edge of the subsequent sheet S2 overlap each other in the conveying direction. Then, the leading edge of the preceding sheet S1 is allowed to abut against the reference member 208.

Figure 6E:
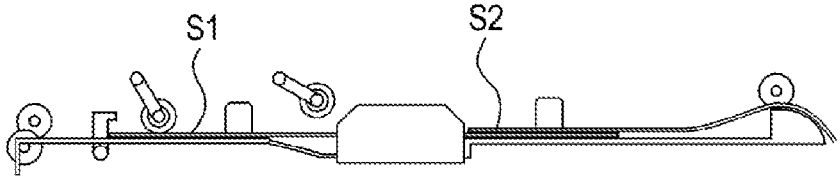

FIG. 6E illustrates a state where the leading edge of the preceding sheet S1 is conveyed to a position abutting against the abutting surface of the reference member 208, and the alignment process is completed. After the leading edge of the preceding sheet is allowed to abut against the reference member 208, the sheet feeding roller 211 is separated from the preceding sheet S1 to be ready for the alignment operation for the subsequent sheet S2.

As described above, in the third embodiment, the plurality of sheet feeding rollers 207 and 211 is disposed along the sheet conveying direction, and at least one of sheet feeding rollers, that is, the sheet feeding roller 211, is provided at a position closer to the reference member 208 than the other sheet feeding roller 207. This further provides an advantageous effect of preventing an alignment failure caused by a kickback due to buckling of a sheet and an alignment failure of a flexible sheet or a curled sheet, in addition to the advantageous effects obtained by the first and second embodiments described above. Moreover, for example, even when the leading edge of the subsequent sheet reaches the sheet feeding roller 207 at the conveying direction upstream side, the preceding sheet can be conveyed by the sheet feeding roller 211 at the conveying direction downstream side, thereby reliably causing each sheet to abut against the reference member 208.

Figure 8:
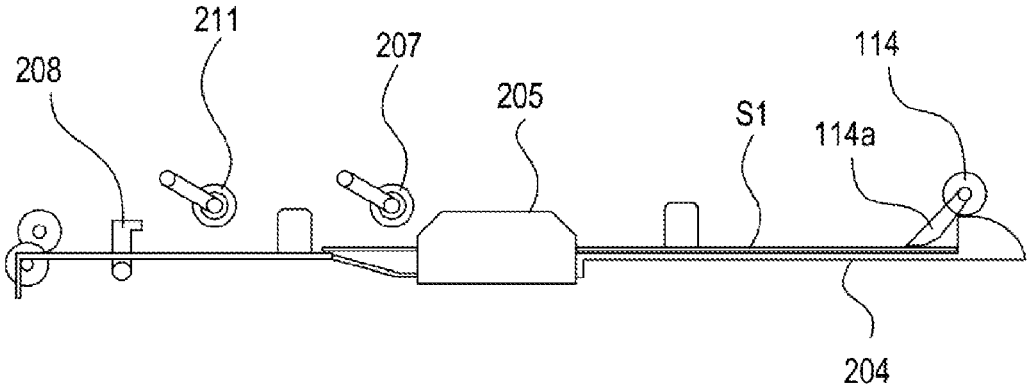
FIG. 8 is an explanatory diagram illustrating a modified example of the sheet processing apparatus.

FIG. 8 is a diagram illustrating a modified example of the sheet processing apparatus. In the modified example illustrated in FIG. 8, a pressing member 114*a* is rotatably provided on the shaft of the upper roller of the pair of conveying rollers 114. The pressing member 114*a* is biased counterclockwise by its own weight. The pressing member 114*a* presses the upstream edge of the sheet discharged onto the processing tray 204 from above at the leading edge (lower edge). The pressing member 114*a* prevents the subsequent sheet from sliding under the preceding sheet previously stacked on the processing tray 204.

The embodiments described above illustrate a copying machine as an example of the image forming apparatus, but the present invention is not limited thereto. For example, the present invention can also be applied to other image forming apparatuses such as a printer and a facsimile apparatus, and to other image forming apparatuses such as a multifunction machine including a combination of these functions. The same advantageous effects can be obtained by applying the present invention to a sheet processing apparatus used for these image forming apparatuses. Further, the present invention is not limited to the structure in which the sheet feeding portion allows the leading edge of the preceding sheet to abut against the reference member before the leading edge of the subsequent sheet reaches the sheet feeding portion. Even when the subsequent sheet reaches the sheet feeding portion before the preceding sheet abuts against the reference member, the preceding sheet is caused to abut against the reference member due to a friction between sheets.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-181640, filed Aug. 23, 2011, which is hereby incorporated by reference herein in its entirety.

What is claimed is:

1. A sheet processing apparatus comprising:

a stacking portion on which a sheet is stacked;

a sheet conveying portion which conveys the sheet to the stacking portion;

a reference member against which a downstream edge of the sheet in a conveying direction abut for aligning the downstream edge of the sheet;

a sheet feeding portion which feeds the sheet stacked on the stacking portion in the conveying direction to cause the downstream edge of the sheet to abut against the reference member; and a controller which controls operations of the sheet conveying portion and the sheet feeding portion, wherein the controller controls the sheet conveying portion and the sheet feeding portion in such a manner that the sheet conveying portion conveys a subsequent sheet so that a downstream portion of the subsequent sheet overlaps an upstream portion of a preceding sheet, then a downstream edge of the preceding sheet reaches the reference member before a downstream edge of the subsequent sheet reaches the sheet feeding portion in a status where there is overlapping between the downstream portion of the subsequent sheet and the upstream portion of the preceding sheet.

2. The sheet processing apparatus according to claim 1, wherein the sheet feeding portion includes a sheet feeding member that abuts against the sheet stacked on the stacking portion and an actuator for moving the sheet feeding member so that the sheet feeding member is separated from the sheet stacked on the stacking portion, and the controller controls the sheet conveying portion and the sheet feeding portion in such a manner that:

the sheet feeding portion is caused to retract from the preceding sheet before the upstream edge of the subsequent sheet is discharged from the sheet conveying portion.

3. The sheet processing apparatus according to claim 1, wherein the controller sets a conveying speed for conveying the sheet by the sheet feeding portion to be equal to a conveying speed for conveying the sheet by the sheet conveying portion, and the controller controls the sheet conveying portion and the sheet feeding portion in such a manner that an operation for feeding the preceding sheet by the sheet feeding portion is started when a distance between the downstream edge of the preceding sheet and the reference member is shorter than a distance between the downstream edge of the subsequent sheet and the sheet feeding portion, after the downstream portion of the subsequent sheet conveyed by the sheet conveying portion overlaps the upstream portion of the preceding sheet.

4. The sheet processing apparatus according to claim 1, wherein the sheet feeding portion includes a first sheet feeding member which feeds the sheet from the sheet conveying portion and a second sheet feeding member, disposed on downstream of the first sheet feeding member, which feeds the sheet in the conveying direction to cause the downstream edge of the sheet to abut against the reference member.

5. The sheet processing apparatus according to claim 1, wherein a friction coefficient of the sheet feeding portion is set to a friction coefficient that causes the sheet feeding portion to slip on the sheet abutting against the reference member when the downstream edge of the sheet abuts against the reference member.

6. The sheet processing apparatus according to claim 1, further comprising an aligning portion which presses an edge in a width direction of the sheet stacked on the stacking portion to align the edge in the width direction of the sheet, the width direction being perpendicular to the conveying direction, wherein the aligning portion aligns the preceding sheet before the conveying direction downstream edge of the subsequent sheet reaches an operation area of the aligning portion and retracts to an outside of a sheet conveying area.

7. The sheet processing apparatus according to claim 1, wherein the reference member is provided to be movable to a position projecting from a stacking surface of the stacking portion serving as an alignment reference, and to a position which does not interfere with discharging of the sheet from the stacking portion.

8. The sheet processing apparatus according to claim 1, further comprising a binding processing portion which is provided to the stacking portion and performs a binding process on a sheet bundle with a downstream edge abutting against the reference member.

9. The sheet processing apparatus according to claim 1, wherein the controller repeats an operation of starting the operation for feeding the preceding sheet by the sheet feeding portion to allow the downstream edge of the preceding sheet to abut against the reference member, after the downstream portion conveyed by the sheet conveying portion overlaps the upstream portion of the preceding sheet stacked on the stacking portion.

10. The sheet processing apparatus according to claim 1, wherein an operation for feeding a preceding sheet by the sheet feeding portion is started after a downstream portion of a subsequent sheet in the conveying direction conveyed by the sheet conveying portion overlaps an upstream portion of the preceding sheet in the conveying direction.

11. An image forming apparatus comprising:

an image forming portion which forms an image on a sheet;

a stacking portion on which a sheet having an image formed thereon by the image forming portion is stacked;

a sheet conveying portion which conveys the sheet to the stacking portion;

a reference member against which a downstream edge of the sheet in a conveying direction abut for aligning the downstream edge of the sheet;

a sheet feeding portion which feeds the sheet stacked on the stacking portion in the conveying direction to cause the downstream edge of the sheet to abut against the reference member; and a controller which controls operations of the sheet conveying portion and the sheet feeding portion, wherein the controller controls the sheet conveying portion and the sheet feeding portion in such a manner that the sheet conveying portion conveys a subsequent sheet so that a downstream portion of the subsequent sheet overlaps an upstream portion of the preceding sheet, then a downstream edge of the preceding sheet reaches the reference member before a downstream edge of the subsequent sheet reaches the sheet feeding portion in a status where there is overlapping between the downstream portion of the subsequent sheet and the upstream portion of the preceding sheet.

12. The image forming apparatus according to claim 11, wherein the sheet feeding portion includes a sheet feeding member that abuts against the sheet stacked on the stacking portion and an actuator for moving the sheet feeding member so that the sheet feeding member is separated from the sheet stacked on the stacking portion, and the controller controls the sheet conveying portion and the sheet feeding portion in such a manner that:

the sheet feeding portion is caused to retract from the preceding sheet before the upstream edge of the subsequent sheet is discharged from the sheet conveying portion.

13. The image forming apparatus according to claim 11, wherein the controller sets a conveying speed for conveying the sheet by the sheet feeding portion to be equal to a conveying speed for conveying the sheet by the sheet conveying portion, and the controller controls the sheet conveying portion and the sheet feeding portion in such a manner that an operation for feeding the preceding sheet by the sheet feeding portion is started when a distance between the downstream edge of the preceding sheet and the reference member is shorter than a distance between the downstream edge of the subsequent sheet and the sheet feeding portion, after the downstream portion of the subsequent sheet conveyed by the sheet conveying portion overlaps the upstream portion of the preceding sheet.

14. The image forming apparatus according to claim 11, wherein the sheet feeding portion includes a first sheet feeding member which feeds the sheet from the sheet conveying portion and a second sheet feeding member, disposed on downstream of the first sheet feeding member, which feeds the sheet in the conveying direction to cause the downstream edge of the sheet to abut against the reference member.

15. The image forming apparatus according to claim 11, wherein a friction coefficient of the sheet feeding portion is set to a friction coefficient that causes the sheet feeding portion to slip on the sheet abutting against the reference member when the downstream edge of the sheet abuts against the reference member.

16. The image forming apparatus according to claim 11, further comprising an aligning portion which presses an edge in a width direction of the sheet stacked on the stacking portion to align the edge in the width direction of the sheet, the width direction being perpendicular to the conveying direction, wherein the aligning portion aligns the preceding sheet before the conveying direction downstream edge of the subsequent sheet reaches an operation area of the aligning portion and retracts to an outside of a sheet conveying area.

17. The image forming apparatus according to claim 11, wherein the reference member is provided to be movable to a position projecting from a stacking surface of the stacking portion serving as an alignment reference, and to a position which does not interfere with discharging of the sheet from the stacking portion.

18. The image forming apparatus according to claim 11, further comprising a binding processing portion which is provided to the stacking portion and performs a binding process for binding a sheet bundle with a downstream edge abutting against the reference member.

19. The image forming apparatus according to claim 18, further comprising:

an image reading portion which is provided above the image forming portion and reads an image formed on an original; and a bundle discharge portion which discharges a sheet bundle to an outside of the image forming apparatus, the sheet bundle being subjected to the binding process by the binding processing portion;

wherein the sheet conveying portion is provided on one side of the image forming apparatus and the bundle discharge portion is provided on the other side of the image forming apparatus, and the stacking portion includes a substantially horizontal stacking surface and is provided between the sheet conveying portion and the bundle discharge portion below the image reading portion.

20. The sheet processing apparatus according to claim 1, wherein the controller controls the sheet feeding portion and the sheet conveying portion in such a manner that the sheet feeding portion feeds a last sheet of a job to continue the conveyance of the sheet by the sheet conveying portion.

21. The sheet processing apparatus according to claim 11, wherein the controller controls the sheet feeding portion and the sheet conveying portion in such a manner that the sheet feeding portion feeds a last sheet of a job to continue the conveyance of the sheet by the sheet conveying portion.

22. The image forming apparatus according to claim 11, wherein an operation for feeding a preceding sheet by the sheet feeding portion is started after a downstream portion of a subsequent sheet in the conveying direction conveyed by the sheet conveying portion overlaps an upstream portion of the preceding sheet in the conveying direction.

23. A sheet processing apparatus comprising:

a stacking portion on which a sheet is stacked;

a sheet conveying portion which conveys the sheet to the stacking portion;

a reference member against which a downstream edge of the sheet in a conveying direction abuts for aligning the downstream edge of the sheet;

a sheet feeding portion which feeds the sheet stacked on the stacking portion in the conveying direction to cause the downstream edge of the sheet to abut against the reference member;

an aligning portion which presses a side edge in a width direction of the sheet stacked on the stacking portion to align the side edge in the width direction of the sheet, the width direction being perpendicular to the conveying direction; and a controller which controls operations of the sheet conveying portion and the sheet feeding portion, wherein the controller controls the sheet conveying portion and the sheet feeding portion in such a manner that the sheet conveying portion conveys a subsequent sheet so that a downstream portion of the subsequent sheet overlaps an upstream portion of a preceding sheet, then a downstream edge of the preceding sheet reaches the reference member before a downstream edge of the subsequent sheet reaches the sheet feeding portion in a status where there is overlapping between the downstream portion of the subsequent sheet and the upstream portion of the preceding sheet, wherein the aligning portion aligns the preceding sheet before the conveying direction downstream edge of the subsequent sheet reaches an operation area of the aligning portion and retracts to an outside of a sheet conveying area.

24. A sheet processing apparatus comprising:

a stacking portion on which a sheet is stacked;

a sheet conveying portion which conveys the sheet to the stacking portion;

a reference member against which a downstream edge of the sheet in a conveying direction abuts for aligning the downstream edge of the sheet;

a sheet feeding portion which feeds the sheet stacked on the stacking portion in the conveying direction to cause the downstream edge of the sheet to abut against the reference member; and a controller which controls operations of the sheet conveying portion and the sheet feeding portion, wherein the controller controls the sheet conveying portion and the sheet feeding portion in such a manner that the sheet conveying portion conveys a subsequent sheet so that a downstream portion of the subsequent sheet overlaps an upstream portion of a preceding sheet, then a downstream edge of the preceding sheet reaches the reference member before a downstream edge of the subsequent sheet reaches the sheet feeding portion in a status where there is overlapping between the downstream portion of the subsequent sheet and the upstream portion of the preceding sheet, wherein the reference member is provided to be movable to a position projecting from a stacking surface of the stacking portion serving as an alignment reference, and to a position which does not interfere with discharging of the sheet from the stacking portion.

* * * * *